US007988022B1

(12) United States Patent
Hansson et al.

(10) Patent No.: US 7,988,022 B1
(45) Date of Patent: Aug. 2, 2011

(54) SOCK APPLYING DEVICE

(76) Inventors: Sven Hansson, Warner Robins, GA (US); Michael Hansson, Warner Robins, GA (US)

( * ) Notice: Subject to any disclaimer, the term of this patent is extended or adjusted under 35 U.S.C. 154(b) by 401 days.

(21) Appl. No.: 12/350,753

(22) Filed: Jan. 8, 2009

(51) Int. Cl.
*A47G 25/80* (2006.01)

(52) U.S. Cl. ..... 223/111

(58) Field of Classification Search ..... 223/111–119
See application file for complete search history.

(56) References Cited

U.S. PATENT DOCUMENTS

| | | | | |
|---|---|---|---|---|
| 2,919,840 | A | 1/1960 | Hoagland | |
| 3,883,052 | A | 5/1975 | Wilson | |
| 4,066,194 | A | 1/1978 | Leland | |
| 4,516,704 | A | 5/1985 | Hagman | |
| 4,756,453 | A * | 7/1988 | Pettit et al. | 223/111 |
| 5,050,783 | A | 9/1991 | Hunter | |
| 5,303,856 | A * | 4/1994 | Weatherholt, Sr. | 223/111 |
| 5,626,269 | A | 5/1997 | Duarte | |
| D548,427 | S | 8/2007 | Holt | |
| 2010/0006609 | A1 * | 1/2010 | McAllister et al. | 223/111 |

* cited by examiner

*Primary Examiner* — Shaun R Hurley
*Assistant Examiner* — Andrew W Sutton

(57) ABSTRACT

A sock applying device for helping a user put a sock on his feet comprising a first extension pole; a second extension pole; a first connector pole and a second connector pole for connecting the first extension pole to the second extension pole; a first threaded rod spanning the first extension pole; a second threaded rod spanning the second extension pole; a first spring-loaded clamp for grasping the sock disposed on the second end of the first threaded rod, wherein the first spring-loaded clamp is moveable between a closed position and an open position; and a second spring-loaded clamp for grasping the sock disposed on the second end of the second threaded rod, wherein the second spring loaded clamp is moveable between a closed position and an open position.

4 Claims, 6 Drawing Sheets

SOCK APPLYING DEVICE

FIELD OF THE INVENTION

The present invention is directed to a device for helping a user put socks on his/her feet.

BACKGROUND OF THE INVENTION

Some individuals, such as pregnant women, obese men and women, or elderly individuals, have difficulty putting sock on their feet. The present invention features a sock applying device for helping a user put socks on his/her feet. The sock applying device can also help individuals with limited strength or flexibility.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
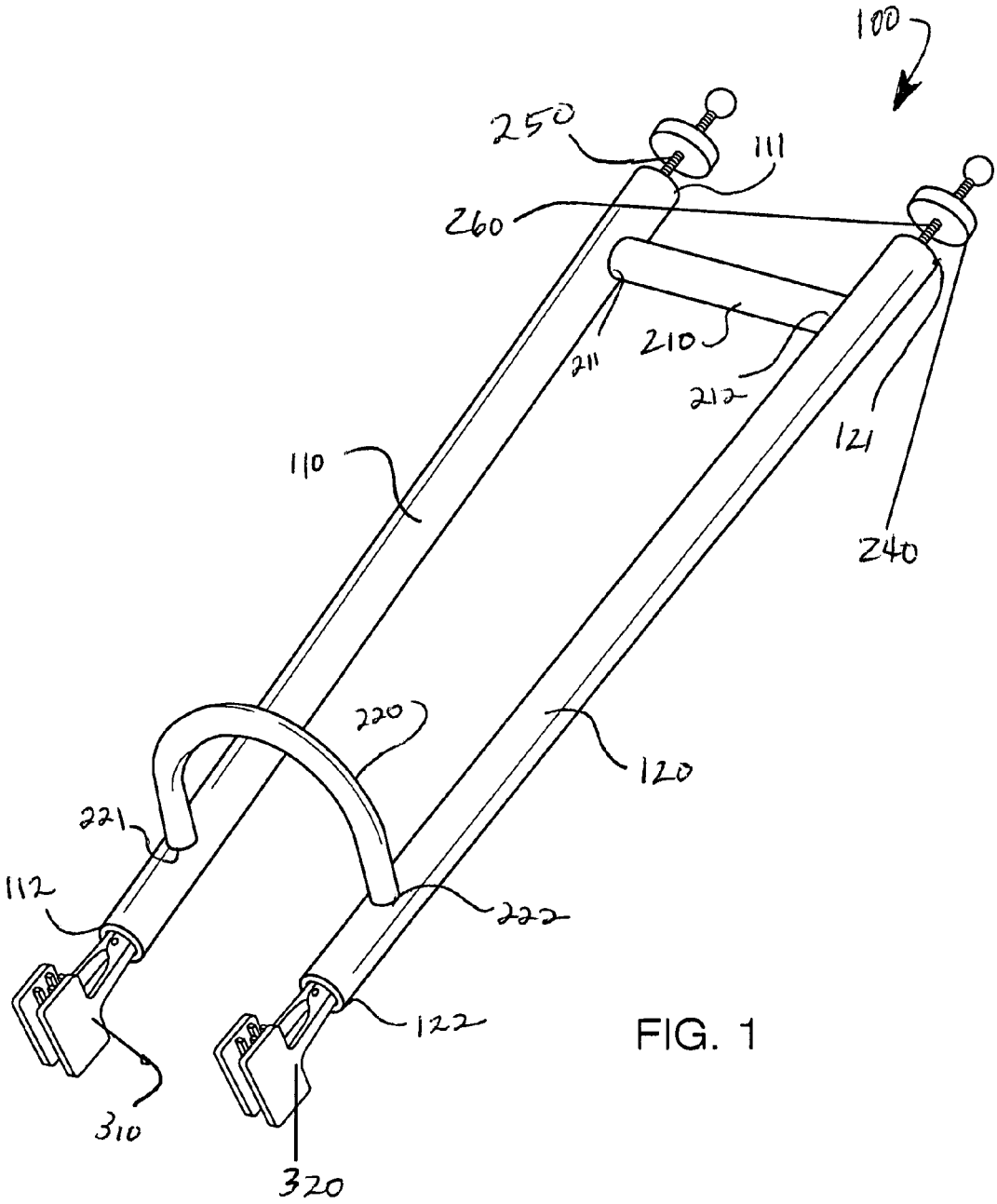
FIG. 1 is a perspective view of the sock applying device of the present invention.
Figure 2:
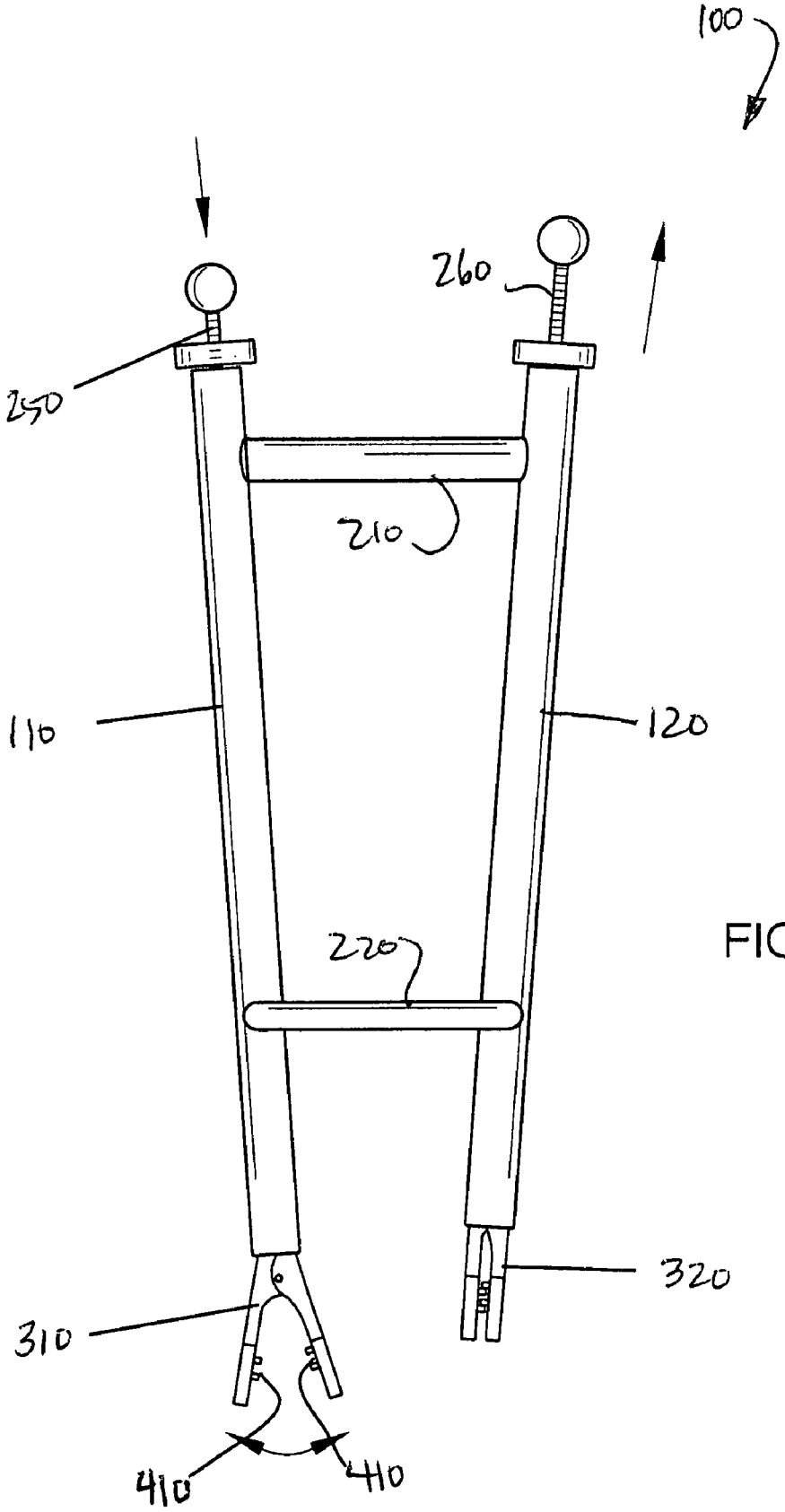
FIG. 2 is a front view of the sock applying device of the present invention.

The following is a listing of numbers corresponding to a particular element refer to herein:

100 sock applying device
110 first extension pole
111 first end of first extension pole
112 second end of second extension pole
120 second extension pole
121 first end of second extension pole
122 second end of second extension pole
210 first connector pole
211 first end of first connector pole
212 second end of first connector pole
220 second connector pole
221 first end of second connector pole
222 second end of second connector pole
240 tightening nut
250 first threaded rod
251 first end of first threaded rod
252 second end of first threaded rod
260 second threaded rod
261 first end of second threaded rod
262 second end of second threaded rod
310 first spring-loaded clamp

311 first half of first spring-loaded clamp
312 second half of first spring-loaded clamp
313 first hinge
314 first spring
315 top edge of first half of first spring-loaded clamp
316 bottom panel of first half of first spring-loaded clamp
317 top edge of second half of first spring-loaded clamp
318 bottom panel of second half of first spring-loaded clamp
319 inner face
320 second spring-loaded clamp
321 first half of second spring-loaded clamp
322 second half of second spring-loaded clamp
323 second hinge
324 second spring
325 top edge of first half of second spring-loaded clamp
326 bottom panel of first half of second spring-loaded clamp
327 top edge of second half of second spring-loaded clamp
328 bottom panel of second half of second spring-loaded clamp
410 grip
510 sock
515 foot
610 plug
620 lower nut Referring now to FIGS. 1-4, the present invention features a sock applying device 100 for helping a user put socks 510 on his/her feet 515. The sock applying device 100 comprises a first extension pole 110 having a first end 111 and a second end 112 and a second extension pole 120 having a first end 121 and a second end 122.

The first extension pole 110 is connected to the second extension pole 120 via a first connector pole 210 having a first end 211 and a second end 212. The first end 211 of the first connector pole 210 is attached near the first end 111 of the first extension pole 110 and the second end 212 of the first connector pole 210 is attached near the first end 121 of the second extension pole 120. In some embodiments, the first connector pole 210 can function as a handle.

The first extension pole 110 and the second extension pole 120 are also connected via a second connector pole 220. The second connector pole 220 is generally U-shaped and has a first end 221 and a second end 222. The first end 221 of the second connector pole 220 is attached to the first extension pole 110 near the second end 112 and the second end 222 of the second connector pole 220 is attached to the second extension pole 120 near the second end 122. In some embodiments, the second connector pole 220 can also function as a handle.

Spanning the length of the first extension pole 110 (as measured from the first end to the second end) and extending from the first end 111 of the first extension pole 110 and the second end 112 of the first extension pole 110 is a first threaded rod 250. The first threaded rod 250 has a first end 251 and a second end 252. The first end 251 of the first threaded rod 250 extends from the first end 111 of the first extension pole 110 and the second end 252 of the first threaded rod 250 extends from the second end 112 of the first extension pole 110.

Spanning the length of the second extension pole 120 (as measured from the first end to the second end) and extending from the first end 121 of the second extension pole 120 and the second end 122 of the second extension pole 120 is a second threaded rod 260. The second threaded rod 260 has a first end 261 and a second end 262. The first end 261 of the second threaded rod 260 extends from the first end 121 of the second extension pole 120 and the second end 262 of the second threaded rod 260 extends from the second end 122 of the second extension pole 120.

Disposed on the second end 252 of the first threaded rod 250 is a first spring-loaded clamp 310 for grasping a sock 510. The first spring-loaded clamp 310 has a first half 311 pivotally connected to a second half 312 via a first hinge 313. The first half 311 has a top edge 315 and a bottom panel 316, wherein the bottom panel 316 has an inner face 319. The second half 312 has a top edge 317 and a bottom panel 318, wherein the bottom panel 318 has an inner face 319. The inner faces 319 of the bottom panels of the first half 311 and second half 312 face each other.

The first spring-loaded clamp 310 is moveable between a closed position and an open position. When the first spring-loaded clamp 310 is in the closed position, the inner face 319 of the bottom panel 316 of the first half 311 and the inner face 319 of the bottom panel 318 of the second half 312 are in contact (see FIG. 3B). When the first spring-loaded clamp 310 is in the open position, the inner face 319 of the bottom panel 316 of the first half 311 and the inner face 319 of the bottom panel 318 of the second half 312 are not in contact (see FIG. 3A). The first spring-loaded clamp 310 is biased in the open position caused by a first spring 314 attached to the first hinge 313.

Disposed on the second end 262 of the second threaded rod 260 is a second spring-loaded clamp 320 for grasping a sock 510. The second spring-loaded clamp 320 has a first half 321 pivotally connected to a second half 322 via a second hinge 323. The first half 321 has a top edge 325 and a bottom panel 326, wherein the bottom panel 326 has an inner face 319. The second half 322 has a top edge 327 and a bottom panel 328, wherein the bottom panel 328 has an inner face 319. The inner faces 319 of the bottom panels of the first half 321 and second half 322 face each other.

The second spring loaded clamp 320 is moveable between a closed position and an open position. When the second spring-loaded clamp 320 is in the closed position, the inner face 319 of the bottom panel 326 of the first half 321 and the inner face 319 of the bottom panel 327 of the second half 322 are in contact (see FIG. 3B). When the second spring-loaded clamp 320 is in the open position, the inner face 319 of the bottom panel 326 of the first half 321 and the inner face 319 of the bottom panel 327 of the second half 322 are not in contact (see FIG. 3A). The second spring-loaded clamp 320 is biased in the open position caused by a second spring 324 attached to the second hinge 323.

Figure 3A:
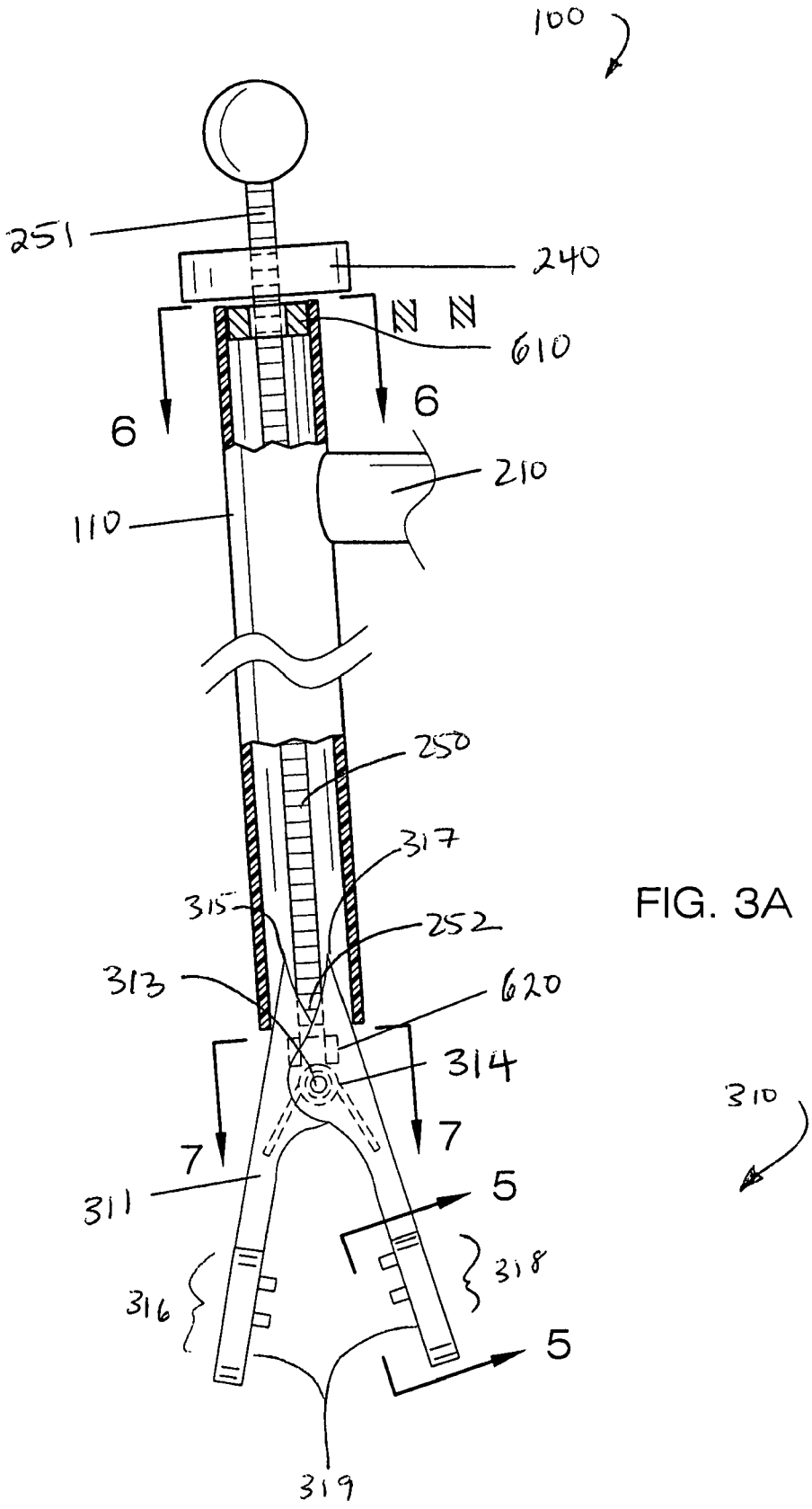
FIG. 3A and FIG. 3B are front and cross sectional views of the sock applying device of the present invention.

The top edge 315 of the first half 311 and the top edge 317 of the second half 312 of the first spring-loaded clamp 310 are slidably insertable into the second end 112 of the first extension pole 110 (see FIG. 3A). A user can slide the first spring-loaded clamp 310 in and out of the first extension pole 110 by pulling and pushing the first threaded rod 250 up and down. When a user pulls the first threaded rod 250 upward, the first spring-loaded clamp 310 is pulled slightly into the first extension pole 110, which compresses the first spring-loaded clamp 310 into the closed position. When a user pushes the first threaded rod 250 downward, the first spring-loaded clamp 310 is pushed out of the first extension pole 110, which allows the first spring 314 to push the first spring-loaded clamp 310 into the open position.

The top edge 325 of the first half 321 and the top edge 327 of the second half 322 of the second spring-loaded clamp 320 are slidably insertable into the second end 122 of the second extension pole 120. A user can slide the second spring-loaded clamp 320 in and out of the second extension pole 120 by pulling and pushing the second threaded rod 260 up and down. When a user pulls the second threaded rod 260 upward, the second spring-loaded clamp 320 is pulled slightly into the second extension pole 120, which compresses the second spring-loaded clamp 320 into the closed position. When a user pushes the second threaded rod 260 downward, the second spring-loaded clamp 320 is pushed out of the second extension pole 120, which allows the second spring 324 to push the second spring-loaded clamp 320 into the open position.

To use the sock applying device 100, a user can insert a first edge of a sock 510 in between the inner faces 319 of the bottom panels of the first spring-loaded clamp 310. Then, he/she can pull the first threaded rod 250 upwards to move the first spring-loaded clamp 310 to the closed position to secure the sock 510 in place. The user can then insert a second edge of a sock 510 in between the bottom panels of the second spring-loaded clamp 320 and pull the second threaded rod 260 upwards to move the second spring-loaded clamp 320 to the closed position to secure the sock 510 in place.

When the sock 510 is securely fastened in the sock applying device 100, the user can then lower the sock applying device 100 towards his/her foot 515 and insert his/her foot into the sock 510. When the sock 510 is securely in place on his/her foot 515, the user can then push the first threaded rod 250 downward and the second threaded rod 260 downward to move the first spring-loaded clamp 310 and second spring-loaded clamp 320 to the open position, respectively. The first spring-loaded clamp 310 and second spring-loaded clamp 320 release the sock 510.

In some embodiments, a grip 410 is disposed on the inner face 319 of the bottom panels of the first half 311 and second half 312 of the first spring-loaded clamp 310. In some embodiments, a grip 410 is disposed on the inner face 319 of the bottom panels of the first half 321 and second half 322 of the second spring-loaded clamp 320. The grips 410 are for helping to secure the sock 510 in place when it is clamped between the first spring-loaded clamp 310 and/or second spring-loaded clamp 320.

In some embodiments, a tightening nut 240 is disposed near the first end 251 of the first threaded rod 250 and near the first end 261 of the second threaded rod 260. In some embodiments, the tightening nut 240 can help to secure the first spring-loaded clamp 310 and/or second spring-loaded clamp 320 in the closed position. For example, a user can pull upward on the first threaded rod 250 such that the first spring-loaded clamp 310 is slid slightly into the first extension pole 110 and moved to the closed position. The user can move the tightening nut 240 down the first threaded rod 250 until it reaches the first end 111 of the first extension pole 110. The tightening nut 240 prevents the first threaded rod 250 from moving downwards and allowing the first spring-loaded clamp 310 move to the open position.

Figure 3B:
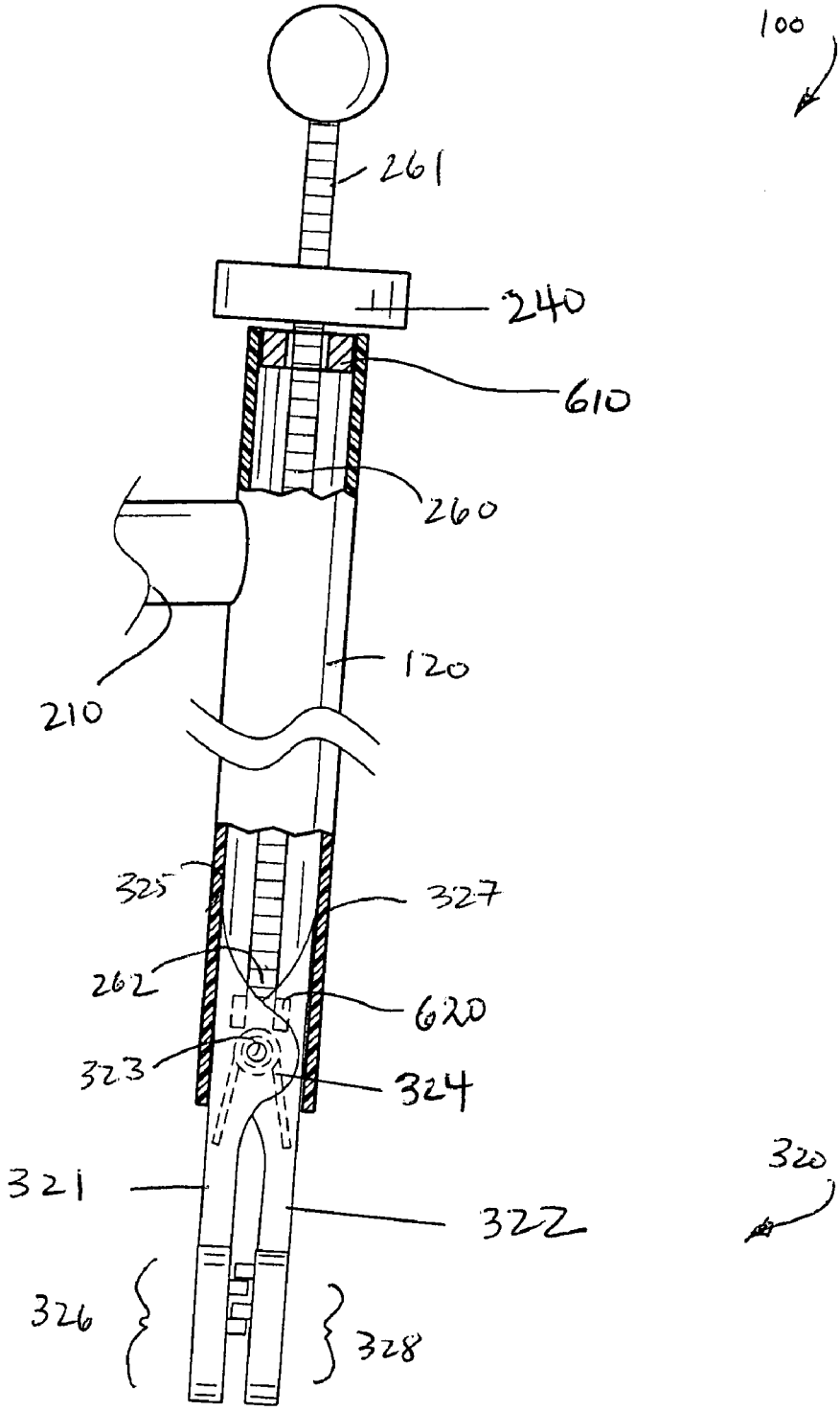
Figure 4:
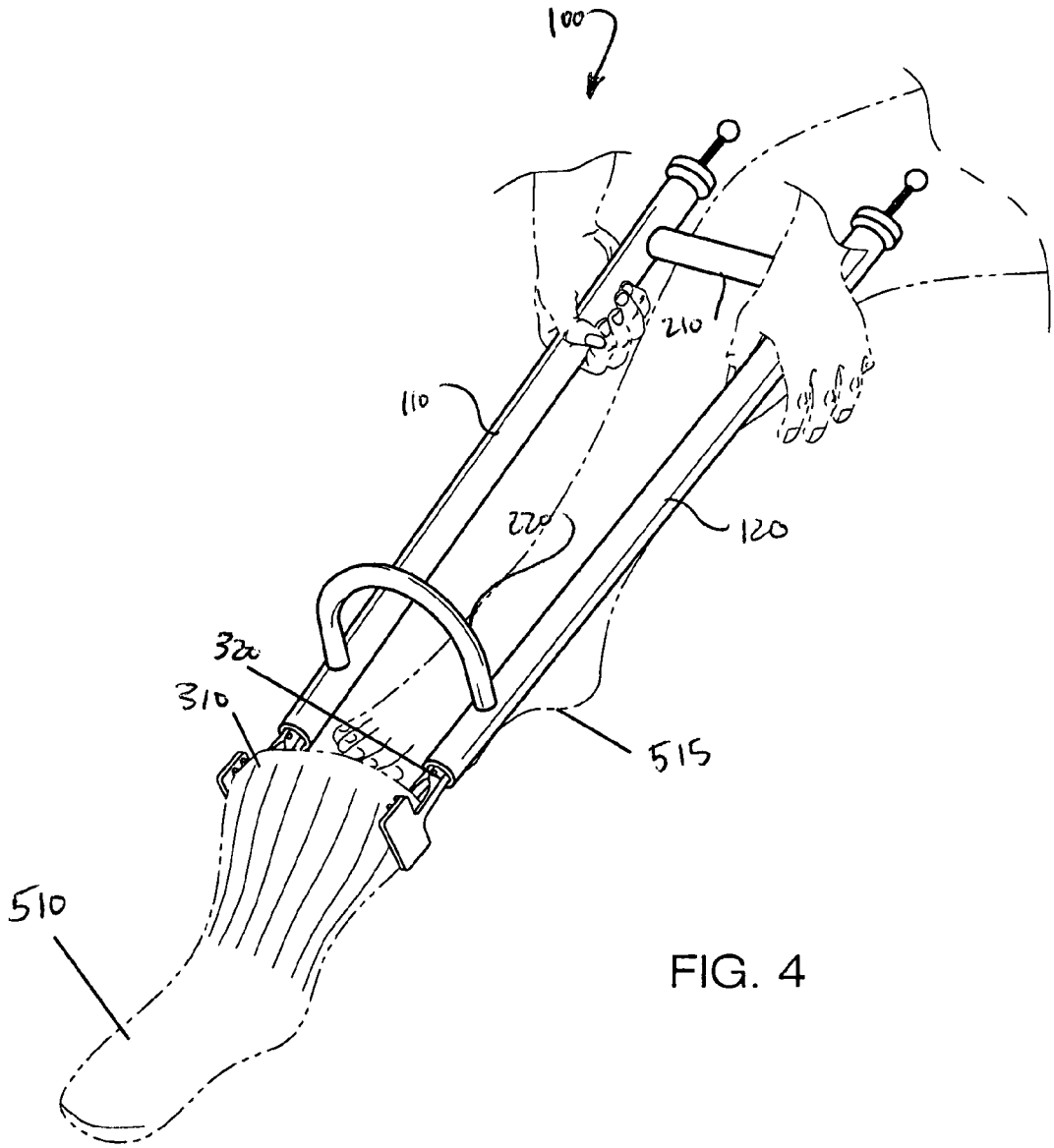
FIG. 4 is a perspective view of the sock applying device of the present invention.
Figure 5:
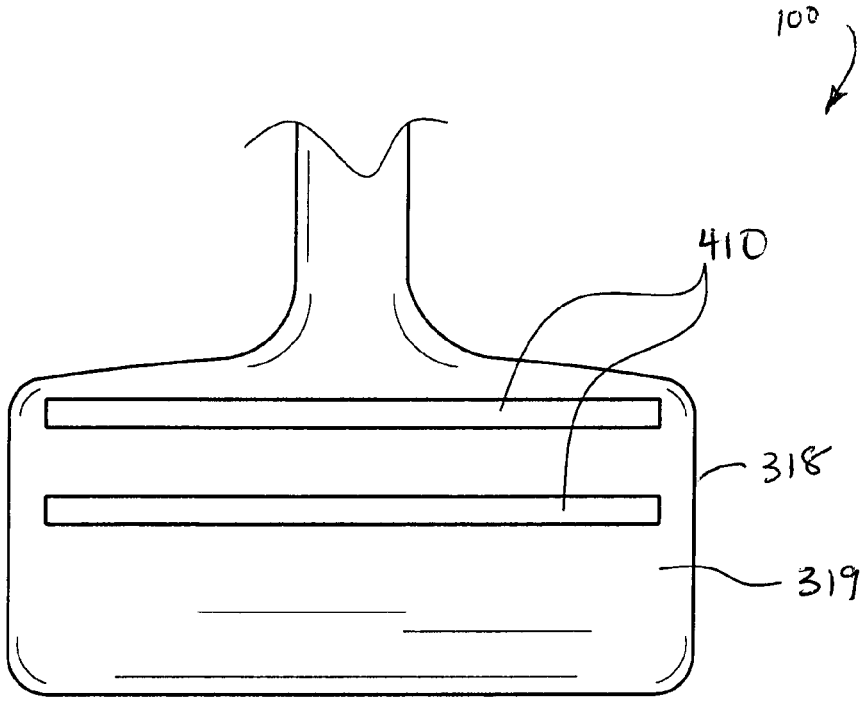
FIG. 5 is a front view of the sock applying device of the present invention.
Figure 6:
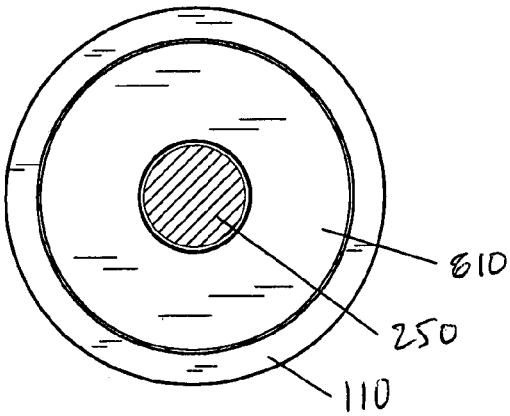
FIG. 6 is a top cross sectional view of the sock applying device of the present invention.

As shown in FIG. 3A and FIG. 6, in some embodiments, the first threaded rod 250 is surrounded by a plug 610 disposed inside the first extension pole 110 at the first end 111. As shown in FIG. 3B and FIG. 6, in some embodiments, the second threaded rod 260 is surrounded by a plug 610 disposed inside the second extension pole 120 at the first end 121. The plug 610 can help to keep the first threaded rod 250 and/or the second threaded rod 260 in place within the first extension pole 110 and/or the second extension pole 120, respectively.

Figure 7:
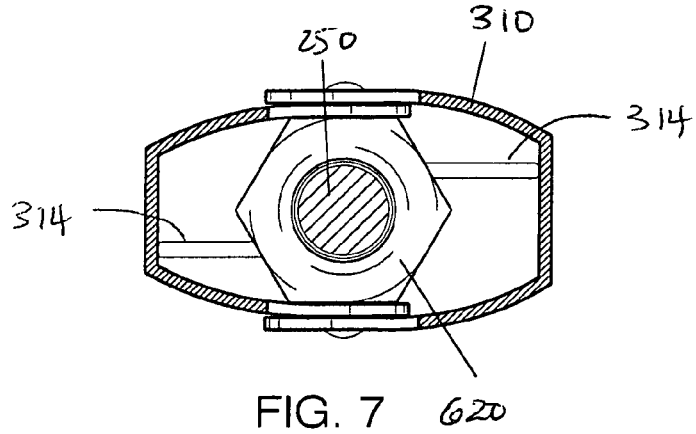
FIG. 7 is a top cross sectional view of the sock applying device of the present invention.

As shown in FIG. 3A and FIG. 7, in some embodiments, the second end 252 of the first threaded rod 250 is threaded through a lower nut 620 located above the first spring-loaded clamp 310. As shown in FIG. 3B and FIG. 7, in some embodiments, the second end 262 of the second threaded rod 260 is threaded through a lower nut 620 located above the second spring-loaded clamp 320.

The sock applying device 100 of the present invention may be constructed from a variety of materials. For example, in some embodiments, the sock applying device 100 is constructed from a material comprising polyvinyl chloride.

As used herein, the term "about" refers to plus or minus 10% of the referenced number. For example, an embodiment wherein the first extension pole 110 is about 20 inches long includes a first extension pole 110 that is between 18 and 22 inches long.

The sock applying device 100 of the present invention may be constructed in a variety of sizes. For example, in some embodiments, the first extension pole 110 and/or the second extension pole 120 is between 20 to 25 inches in length as measured from the first end to the second end. In some embodiments, the first extension pole 110 and/or the second extension pole 120 is between 25 to 30 inches in length as measured from the first end to the second end. In some embodiments, the first extension pole 110 and/or the second extension pole 120 is between 30 to 35 inches in length as measured from the first end to the second end. In some embodiments, the first extension pole 110 and/or the second extension pole 120 is more than about 35 inches in length.

The following the disclosures of the following U.S. patents are incorporated in their entirety by reference herein: U.S. Pat. No. 2,919,840; U.S. Pat. No. 5,050,783; U.S. Pat. No. 3,883,052; U.S. Pat. No. 4,066,194; U.S. Pat. No. 4,516,704; U.S. Pat. No. 5,626,269.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sock applying device for helping a user put a sock on his feet, said sock applying device comprising (a) a first hollow extension pole having a first end and a second end;

(b) a second hollow extension pole having a first end and a second end;

(c) a first connector pole for connecting the first extension pole to the second extension pole; wherein the first connector pole has a first end and a second end; the first end of the first connector pole is attached near the first end of the first extension pole; the second end of the first connector pole is attached near the first end of the second extension pole;

(d) a second connector pole for connecting the first extension pole to the second extension pole; wherein the second connector pole is generally U-shaped and has a first end and a second end; the first end of the second connector pole is attached to the first extension pole near the second end; the second end of the second connector pole is attached to the second extension pole near the second end;

(e) a first threaded rod spanning a length of the first extension pole; wherein the first threaded rod has a first end and a second end; wherein the first end of the first threaded rod extends from the first end of the first extension pole;

(f) a second threaded rod spanning a length of the second extension pole; wherein the second threaded rod has a first end and a second end; wherein the first end of the second threaded rod extends from the first end of the second extension pole;

(g) a first spring-loaded clamp for grasping the sock disposed on the second end of the first threaded rod; wherein the first spring-loaded clamp has a first half pivotally connected to a second half via a first hinge; wherein the first half of the first spring-loaded clamp has a top edge and a bottom panel having an inner face; wherein the second half of the first spring-loaded clamp has a top edge and a bottom panel having an inner face; wherein the inner face of the first half of the first spring-loaded clamp faces the inner face of the second half of the first spring-loaded clamp; wherein the first spring-loaded clamp is moveable between a closed position and an open position; wherein when the first spring-loaded clamp is in the closed position, the inner face of the first half of the first spring-loaded clamp and the inner face of the second half of the first spring-loaded clamp are in contact; wherein when the first spring-loaded clamp is in the open position, the inner face of the first half of the first spring-loaded clamp and the inner face of the second half of the first spring-loaded clamp are not in contact; wherein the first spring-loaded clamp is biased in the open position caused by a first spring attached to the first hinge; and (h) a second spring-loaded clamp for grasping the sock disposed on the second end of the second threaded rod; wherein the second spring-loaded clamp has a first half pivotally connected to a second half via a second hinge; wherein the first half of the second spring-loaded clamp has a top edge and a bottom panel having an inner face; wherein the second half of the second spring-loaded clamp has a top edge and a bottom panel having an inner face; wherein the inner face of the first half of the second spring-loaded clamp faces the inner face of the second half of the second spring-loaded clamp; wherein the second spring loaded clamp is moveable between a closed position and an open position; wherein when the second spring-loaded clamp is in the closed position, the inner face of the first half of the second spring-loaded clamp and the inner face of the second half of the second spring-loaded clamp are in contact; wherein when the second spring-loaded clamp is in the open position, the inner face of the first half of the second spring-loaded clamp and the inner face of the second half of the second spring-loaded clamp are not in contact; wherein the second spring-loaded clamp is biased in the open position caused by a second spring attached to the second hinge;

wherein the user can insert a first edge of the sock in between the bottom panel of the first half of the first spring-loaded clamp and the bottom panel of the second half of the first spring-loaded clamp; wherein the user can insert a second edge of the sock in between the bottom panel of the first half of the second spring-loaded clamp and the bottom panel of the second half of the second spring-loaded clamp;

wherein the top edge of the first half of the first spring-loaded clamp and the top edge of the second half of the first spring-loaded clamp are slidably insertable into the second end of the first extension pole such that the user can slide the first spring-loaded clamp in and out of the first extension pole by pulling and pushing the first threaded rod up and down; wherein the top edge of the first half of the second spring-loaded clamp and the top edge of the second half of the second spring-loaded clamp are slidably insertable into the second end of the second extension pole such that the user can slide the second spring-loaded clamp in and out of the second extension pole by pulling and pushing the second threaded rod up and down;

wherein when the user pulls the first threaded rod upward, the first spring-loaded clamp is pulled slightly into the first extension pole which compresses the first spring-loaded clamp into the closed position; wherein when the user pushes the first threaded rod downward, the first spring-loaded clamp is pushed out of the first extension pole which allows the first spring to push the first spring-loaded clamp into the open position; wherein when the user pulls the second threaded rod upward, the second spring-loaded clamp is pulled slightly into the second extension pole which compresses the second spring-loaded clamp into the closed position; wherein when the user pushes the second threaded rod downward, the second spring-loaded clamp is pushed out of the second extension pole which allows the second spring to push the second spring-loaded clamp into the open position.

2. The sock applying device of claim 1, wherein a tightening nut is disposed near the first end of the first threaded rod and near the first end of the second threaded rod; wherein the tightening nut helps to secure the first spring-loaded clamp and the second spring-loaded clamp in the closed position.

3. The sock applying device of claim 1, wherein a grip for helping to secure the sock in the first spring-loaded clamp is disposed on the inner face of the first half of the first spring-loaded clamp and on the inner face of the second half of the first spring-loaded clamp.

4. The sock applying device of claim 3, wherein a grip for helping to secure the sock in the second spring-loaded clamp is disposed on the inner face of the first half of the second spring-loaded clamp and on the inner face of the second half of the second spring-loaded clamp.

* * * * *